US010109926B2

(12) United States Patent
Choi et al.

(10) Patent No.: US 10,109,926 B2
(45) Date of Patent: Oct. 23, 2018

(54) ANTENNA RADIATOR, ANTENNA AND MOBILE TERMINAL

(71) Applicant: BYD COMPANY LIMITED, Shenzhen, Guangdong (CN)

(72) Inventors: Munyong Choi, Shenzhen (CN); Mingqian Shao, Shenzhen (CN); Wei Zhao, Shenzhen (CN)

(73) Assignee: BYD Company Limited (CN)

( * ) Notice: Subject to any disclaimer, the term of this patent is extended or adjusted under 35 U.S.C. 154(b) by 5 days.

(21) Appl. No.: 15/328,802

(22) PCT Filed: Mar. 25, 2015

(86) PCT No.: PCT/CN2015/075074

§ 371 (c)(1),
(2) Date: Jan. 24, 2017

(87) PCT Pub. No.: WO2016/019733

PCT Pub. Date: Feb. 11, 2016

(65) Prior Publication Data

US 2017/0214143 A1 Jul. 27, 2017

(30) Foreign Application Priority Data

Aug. 7, 2014 (CN) ..... 2014 2 0445855 U

(51) Int. Cl.

| | |
|---|---|
| ***H01Q 13/16*** | (2006.01) |
| ***H01Q 1/48*** | (2006.01) |
| ***H01Q 1/50*** | (2006.01) |
| ***H01Q 1/24*** | (2006.01) |
| ***H01Q 9/04*** | (2006.01) |

(52) U.S. Cl.

CPC ..... *H01Q 13/16* (2013.01); *H01Q 1/243* (2013.01); *H01Q 1/48* (2013.01); *H01Q 1/50* (2013.01); *H01Q 9/0421* (2013.01)

(58) Field of Classification Search

CPC ..... H01Q 5/371; H01Q 5/328; H01Q 5/357; H01Q 5/364; H01Q 5/30; H01Q 1/243; H01Q 1/48; H01Q 9/0421

(Continued)

(56) References Cited

U.S. PATENT DOCUMENTS 8,179,322 B2 * 5/2012 Nissinen ..... H01Q 1/38 343/700 MS
2002/0180650 A1 * 12/2002 Pankinaho ..... H01Q 1/243 343/702

(Continued)

FOREIGN PATENT DOCUMENTS

CN 1816941 8/2006
CN 1947305 4/2007

(Continued)

OTHER PUBLICATIONS

International Search Report corresponding to PCT/CN2015/075074, dated Jun. 19, 2015, 4 pages.

*Primary Examiner* — Dameon E Levi
*Assistant Examiner* — Jennifer F Hu
(74) *Attorney, Agent, or Firm* — Calfee, Halter & Griswold LLP

(57) ABSTRACT

An antenna comprises: a circuit board; an antenna radiator, wherein the antenna radiator is provided with a first gap, a second gap, a first grounding piece, a second grounding piece and a feed piece, the first gap and the second gap forming a first inverted-F antenna connected to the first grounding piece and a second inverted-F antenna connected to the second grounding piece on the antenna radiator, and the feed piece being respectively connected to the first inverted-F antenna and the second inverted-F antenna; and an antenna frequency reconstruction system, wherein the antenna frequency reconstruction system is provided on the circuit board, the antenna frequency reconstruction system is (Continued)

respectively connected to the first grounding piece and the second grounding piece and is grounded, and the antenna frequency reconstruction system switches one of the first grounding piece and the second grounding piece to be grounded. Also provided are an antenna radiator and a mobile terminal.

13 Claims, 6 Drawing Sheets

(58) Field of Classification Search
USPC ..... 343/770
See application file for complete search history.

(56) References Cited

U.S. PATENT DOCUMENTS

2003/0006936 A1* 1/2003 Aoyama ..... H01Q 1/243 343/700 MS
2004/0233109 A1* 11/2004 Ying ..... H01Q 1/243 343/700 MS
2006/0220959 A1* 10/2006 Ying ..... H01Q 1/243 343/700 MS
2008/0100516 A1 5/2008 DiNallo et al.
2009/0174604 A1* 7/2009 Keskitalo ..... H01Q 1/243 343/700 MS
2011/0275333 A1* 11/2011 Kim ..... H01Q 1/243 455/77

FOREIGN PATENT DOCUMENTS

| | | |
|---|---|---|
| CN | 201766162 | 3/2011 |
| CN | 102386485 | 3/2012 |
| CN | 102856632 | 1/2013 |
| CN | 103078174 | 5/2013 |
| CN | 204103033 | 1/2015 |
| EP | 171460713 | 3/2003 |
| EP | 1738434 | 1/2007 |
| WO | 2002071535 | 9/2002 |

* cited by examiner

ANTENNA RADIATOR, ANTENNA AND MOBILE TERMINAL

CROSS REFERENCE TO RELATED APPLICATION

This application is a national phase of International Application No. PCT/CN2015/075074 filed Mar. 25, 2015, which claims priority and benefits of Chinese Patent Application No. 201420445855.0, filed with State Intellectual Property Office, P. R. C. on Aug. 7, 2014, the entire contents of which are incorporated herein by reference.

FIELD

The present disclosure generally relates to a field of wireless communication, specifically, to an antenna radiating sheet, an antenna and a mobile terminal having the same.

BACKGROUND

As a development of wireless communication technology, antennas for mobile phones have tended toward a development of miniaturization and multi-band functioning. Thereby, in order to cover different frequency bands by changing the shape of the antenna, an antenna frequency reconfiguration module is added to some mobile phone antennas.

In the related art, the antenna frequency reconfiguration module is disposed on an antenna radiating body, causing the structure and preparing process thereof to be complicated, so the antenna radiating body cannot be formed integrally, easy to be abnormal because of related stoppage of a pin diode and a blocking capacitor, and covering a narrow frequency band.

SUMMARY

The present disclosure seeks to solve at least one of the problems existing in the related art to at least some extent.

The first objective of the present disclosure is to provide an antenna, the antenna is capable of covering full frequency bands of mobile phone calls, having advantages of wide frequency bands, high radiation efficiency, small volume, simple structure and preparing process, and reliable performance.

The second objective of the present disclosure is to provide a mobile terminal having the antenna mentioned above.

The third objective of the present disclosure is to provide an antenna radiating sheet having the advantage of wide frequency bands, high radiation efficiency and small volume, etc.

In order to achieve the above objectives, the first aspect of the present disclosure provides an antenna, including: a circuit board; an antenna radiating sheet, having a first slot, a second slot, a first ground sheet, a second ground sheet and a feed sheet; the antenna radiating sheet is formed a first inverted F antenna connected with the first ground sheet and a second inverted F antenna connected with the second ground sheet by the first slot and the second slot; the feed sheet is respectively connected with the first inverted F antenna and the second inverted F antenna; an antenna frequency reconfiguration module, disposed on the circuit board; the antenna frequency reconfiguration module is respectively connected with the first ground sheet and the second ground sheet, and connected to ground; the antenna frequency reconfiguration module is configured to switch one of the first ground sheet and the second ground sheet to connect to ground.

According to the antenna of present disclosure, with the first slot and the second slot disposed on the antenna radiating sheet, it is capable of forming a first inverted F antenna and a second inverted F antenna on the antenna radiating sheet; with the first ground sheet, the second ground sheet and the feed sheet disposed on the antenna radiating sheet, a feed point and two ground points are formed, thereby it is capable of forming an electrically tuned double inverted F antenna (EDIFA for short). With the antenna frequency reconfiguration module controlling the first ground sheet and the second ground sheet, two working modes are formed, so as to achieve full frequency band coverage. Moreover, the first inverted F antenna and the second inverted F antenna share the antenna radiating sheet, reducing the volume of the antenna greatly, and the antenna frequency reconfiguration module achieves frequency reconfiguration through control of switching the first ground sheet and the second ground sheet, compared with control of switching the feed point and the antenna radiating sheet in related arts, the antenna of present disclosure is more simple, more easy to achieve and has more reliable performance. In addition, the antenna frequency reconfiguration module is disposed on the circuit board, thereby it is capable of simplifying the structure and preparing process of the antenna radiating sheet greatly, and convenient for the antenna radiating sheet to be formed integrally.

In addition, the antenna of the present disclosure may have additional technical features as follows:

In some embodiments, the antenna radiating sheet includes: a horizontal part, extended in a left and right direction in a horizontal plane, the feed sheet and the first ground sheet is disposed on a back edge of the horizontal part; a vertical part, extended in a left and right direction in a vertical plane, an upper edge of the vertical part is connected with a front edge of the horizontal part, the second ground sheet is disposed on a lower edge of the vertical part. Thereby, it is not only convenient for the first slot and the second slot to form the first inverted F antenna and the second inverted F antenna on the antenna radiating sheet, but also convenient for the first ground sheet, the second ground sheet and the feed sheet to be disposed.

In some embodiments, the first slot includes: a first horizontal front and back limb, penetrating the horizontal part in a front and back direction; a first vertical up and down limb, disposed on the vertical part and extended in an up and down direction, an upper end of the first up and down vertical limb is connected with a front end of the first horizontal front and back limb; a first vertical left and right limb, disposed on the vertical part and extending in a left and right direction, a right end of the first vertical left and right limb is connected with a lower end of the first vertical up and down limb. Thereby, the first inverted F antenna is formed on the antenna radiating sheet.

In some embodiments, the second slot includes: a second horizontal front and back limb, disposed on the horizontal part and extending in a front and back direction; the second horizontal front and back limb is located on the left side of the first horizontal front and back limb, a back edge of the horizontal part is penetrated by a back end of the second horizontal front and back limb; a second horizontal left and right limb, disposed on the horizontal part and extending in a left and right direction, a right end of the second horizontal left and right limb is connected with a front end of the second horizontal front and back limb. Thereby, the second inverted F antenna is formed on the antenna radiating sheet, and having a high isolation degree.

In some embodiments, the feed sheet is located between the first horizontal front and back limb and the second horizontal front and back limb, the first ground sheet is located on the right side of the first horizontal front and back limb, the feed sheet and the first ground sheet are respectively extended downward from the back edge of the horizontal part, and the lower ends thereof are bended towards the vertical part. Thereby, it is not only convenient for the connection of the antenna radiating sheet and the antenna frequency reconfiguration module, but also convenient for the first inverted F antenna to work alone.

In some embodiments, the second ground sheet is disposed near to a left edge of the vertical part, and extending backward from a lower edge of the vertical part, and bended upward and backward sequentially. Thereby, it is not only convenient for the connection of the antenna radiating sheet and the antenna frequency reconfiguration module, but also convenient for the second inverted F antenna to work alone.

In some embodiments, a length of each of the horizontal part and the vertical part is 20 mm to 100 mm and a thickness of each thereof is both 0.02 mm to 0.2 mm, a width of the horizontal part is 1 mm to 20 mm, a width of the vertical part is less than or equal to 10 mm. Thereby, it is capable of ensuring the antenna radiating sheet having a small volume, while the reliability of performance is not affected.

In some embodiments, a distance between a left edge of the first horizontal front and back limb and a left edge of the horizontal part is 41.4 mm to 51.4 mm, a distance between an upper edge of the first vertical left and right limb and an upper edge of the vertical part is 1.5 mm to 2.5 mm, a length of the first vertical left and right limb is 21 mm to 22 mm, the width of each of the first horizontal front and back limb, the first vertical up and down limb and the first vertical left and right limb is 1.1 mm to 2.1 mm. Thereby, it is capable of ensuring the frequency band coverage of the first inverted F antenna and the effect of signal transmission.

In some embodiments, a distance between a left edge of the second horizontal front and back limb and a left edge of the horizontal part is 38 mm to 39 mm, a distance between a back edge of the second horizontal left and right limb and a back edge of the horizontal part is 3.1 mm to 4.1 mm, a length of the second horizontal left and right limb is 28.5 mm to 29.5 mm, the width of each of the second horizontal front and back limb and the second horizontal left and right limb are 0.5 mm to 1.5 mm. Thereby, it is capable of ensuring the frequency band coverage of the second inverted F antenna and the effect of signal transmission.

In some embodiments, a length of the feed sheet is 5 mm to 15 mm and a width thereof is 1 mm to 7.5 mm, a distance between a left edge of the feed sheet and a left edge of the horizontal part is 42 mm to 45 mm, a length of the first ground sheet is 5 mm to 15 mm and a width thereof is 1 mm to 10 mm, a distance between a right edge of the first ground sheet and a right edge of the horizontal part is less than or equal to 12 mm. Thereby, it is not only capable of ensuring access effect of the feed sheet and the first ground sheet, but also may be convenient for the frequency band coverage of the first inverted F antenna.

In some embodiments, a length of the second ground sheet is 5 mm to 15 mm and a width thereof is 1 mm to 10 mm, a distance between a left edge of the second ground sheet and a left edge of the vertical part is less than or equal to 1 mm. Thereby, it is not only capable of ensuring access effect of the second ground sheet, but also may be convenient for the frequency band coverage of the second inverted F antenna.

In some embodiments, the antenna frequency reconfiguration module is one of a diode reconfiguration module, a single-pole double throw reconfiguration module and a micro motor reconfiguration module.

In some embodiments, the antenna frequency reconfiguration module is the diode reconfiguration module, including: a first controlling end, connected with the first ground sheet through a first resistance, a first inductance and a first blocking capacitor sequentially; a first shunt capacitance, connected with a point between the first resistance and the first inductance, and connected to ground; a first diode, connected with a point between the first inductance and the first blocking capacitor, and connected to ground; a second controlling end, connected with the second ground sheet through a second resistance, a second inductance and a second blocking capacitor sequentially; a second shunt capacitance, connected with a point between the second resistance and the second inductance, and connected to ground; a second diode, connected with a point between the second inductance and the second blocking capacitor, and connected to ground.

The second aspect of the present disclosure provides a mobile terminal including the antenna according to the first aspect of the present disclosure embodiments.

According to the mobile terminal of the present disclosure, the antenna according to the first aspect of the present disclosure embodiments, has advantages including wide application range, favorable communication effect, small volume, simple structure and preparing process, and reliable performance.

The third aspect of the present disclosure provides an antenna radiating sheet including a first slot, a second slot, a first ground sheet, a second ground sheet and a feed sheet; the antenna radiating sheet is formed a first inverted F antenna connected with the first ground sheet and a second inverted F antenna connected with the second ground sheet by the first slot and the second slot; the feed sheet is respectively connected with the first inverted F antenna and the second inverted F antenna.

According to the antenna radiating sheet of the present disclosure, it is capable of covering full frequency bands of global mobile phone calls, having advantages of wide frequency bands, high radiation efficiency and small volume.

Additional aspects and advantages of embodiments of the present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
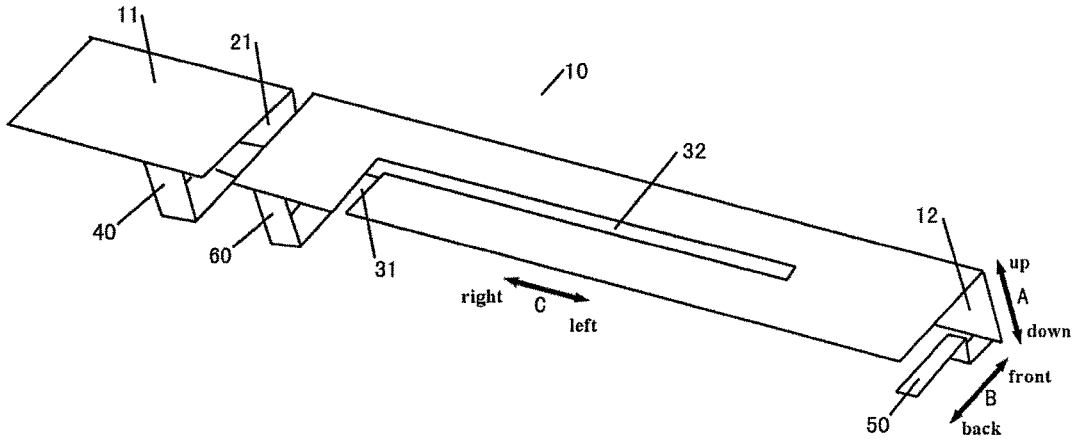
FIG. 1 is a schematic view of a three dimensional structure of the antenna radiating sheet according to an embodiment of the present disclosure.

Reference will be made in detail to embodiments of the present disclosure. Embodiments of the present disclosure will be shown in drawings, in which the same or similar elements and the elements having same or similar functions are denoted by like reference numerals throughout the descriptions. The embodiments described herein according to drawings are explanatory and illustrative, not to be construed to limit the present disclosure.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied. Moreover, a structure in which a first feature is "on" a second feature may include an embodiment in which the first feature directly contacts the second feature, and may also include an embodiment in which an additional feature is formed between the first feature and the second feature so that the first feature does not directly contact the second feature.

In the description of the present disclosure, unless specified or limited otherwise, it should be noted that, terms "mounted," "connected" and "coupled" may be understood broadly, such as electronic connections or mechanical connections, inner communications between two elements, direct connections or indirect connections through intervening structures, which can be understood by those skilled in the art according to specific situations.

With reference to the following descriptions and drawings, these and other aspects of embodiments of the present disclosure will become apparent. In the descriptions and drawings, some particular embodiments are described in order to show the principles of embodiments according to the present disclosure, however, it should be appreciated that the scope of embodiments according to the present disclosure is not limited herein. On the contrary, changes, alternatives, and modifications can be made in the embodiments without departing from spirit, principles and scope of the attached claims.

In the following, the antenna of the present disclosure will be described in detail with reference to the drawings.

As shown in FIG. 1 to FIG. 12, the antenna according to the present disclosure includes a circuit board (not shown in drawings), an antenna radiating sheet 10 and an antenna frequency reconfiguration module.

On the antenna radiating sheet 10, a first slot 20, a second slot 30, a first ground sheet 40, a second ground sheet 50 and a feed sheet 60 are disposed. The antenna radiating sheet 10 is formed a first inverted F antenna and a second inverted F antenna by the first slot 20 and the second slot 30. The first inverted F antenna is connected with the first ground sheet 40, the second inverted F antenna is connected with the second ground sheet 50, the feed sheet 60 is respectively connected with the first inverted F antenna and the second inverted F antenna.

The antenna frequency reconfiguration module is disposed on the circuit board, the antenna frequency reconfiguration module is respectively connected with the first ground sheet 40 and the second ground sheet 50, and connected to ground. The antenna frequency reconfiguration module is configured to switch one of the first ground sheet 40 and the second ground sheet 50 to connect to ground.

According to the antenna of the present disclosure, with the first slot 20 and the second slot 30 disposed on the antenna radiating sheet 10, it is capable of forming a first inverted F antenna and a second inverted F antenna on the antenna radiating sheet 10, and with the first ground sheet 40 and the feed sheet 60 disposed on the antenna radiating sheet 10, also with the second ground sheet 50 added furtherly, a feed point and two ground points of the antenna are formed, thereby it is capable of forming an electrically tuned double inverted F antenna (EDIFA for short). With the antenna frequency reconfiguration module controlling the first ground sheet 40 and the second ground sheet 50, two working modes of the antenna are formed, so as to achieve full frequency band coverage, and the radiation efficiency is high, at the same time solving the problem of five frequencies 3G (Third Generation Mobile Communication Technology Specification) antenna in related arts cannot cover the low frequency portion of LTE (Long Term Evolution).

Figure 7:
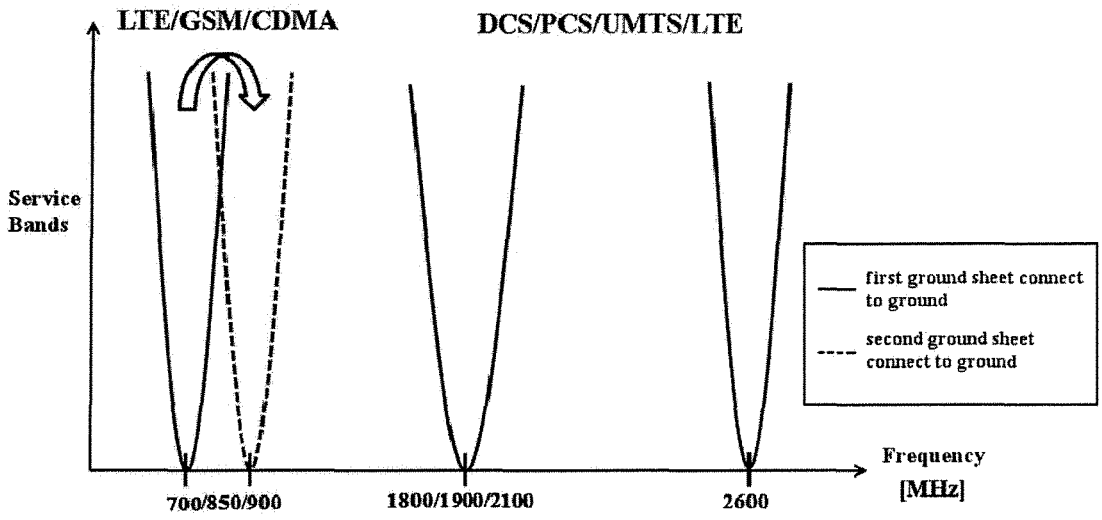
FIG. 7 is a frequency-service bands graph of the antenna according to an embodiment of the present disclosure.
Figure 8:
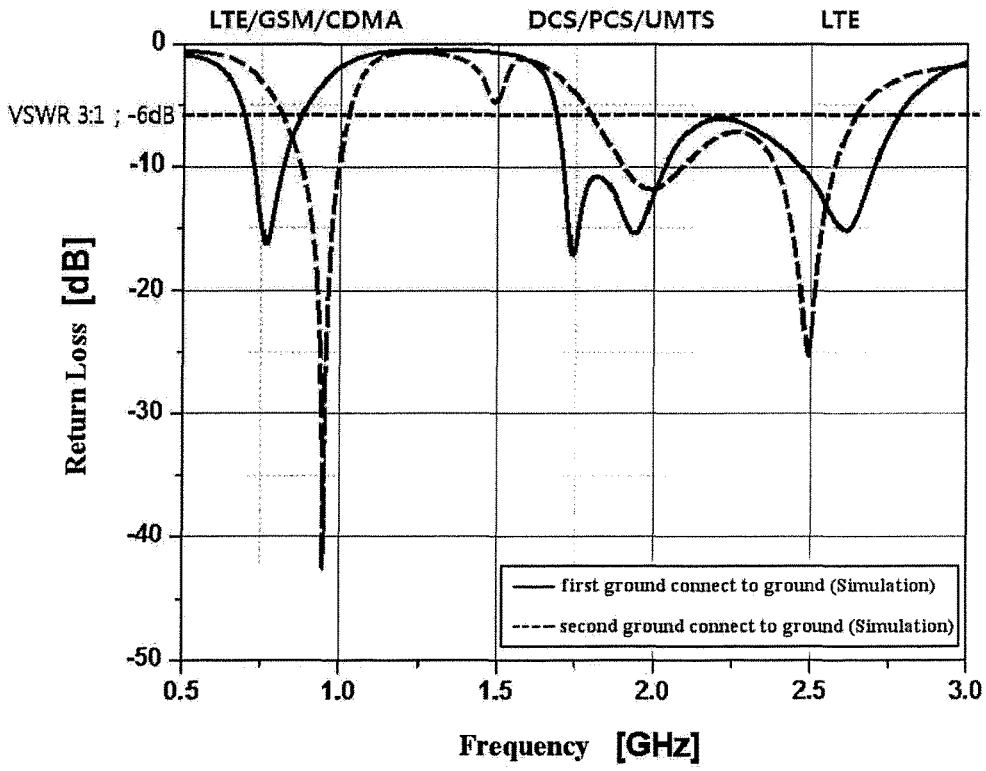
FIG. 8 is a simulation frequency-return loss graph of the antenna according to an embodiment of the present disclosure.
Figure 9:
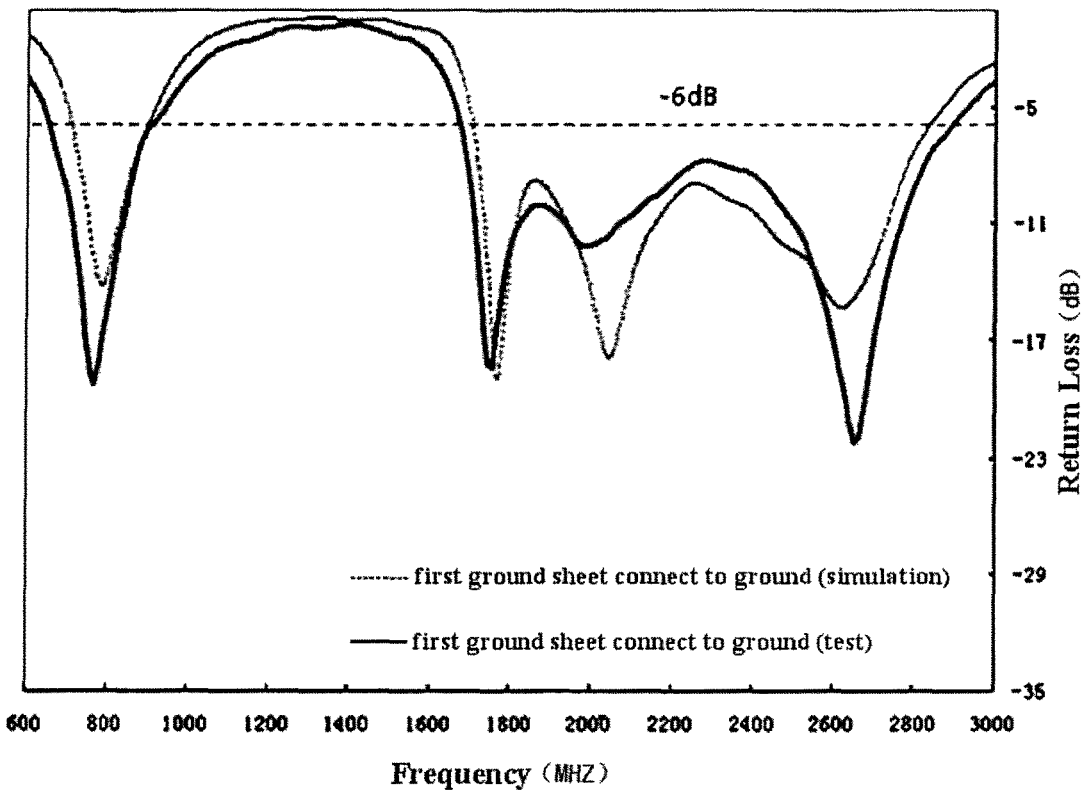
FIG. 9 is a simulation and measurement frequency-return loss graph of the antenna according to an embodiment of the present disclosure when the first ground sheet is connected to ground.
Figure 10:
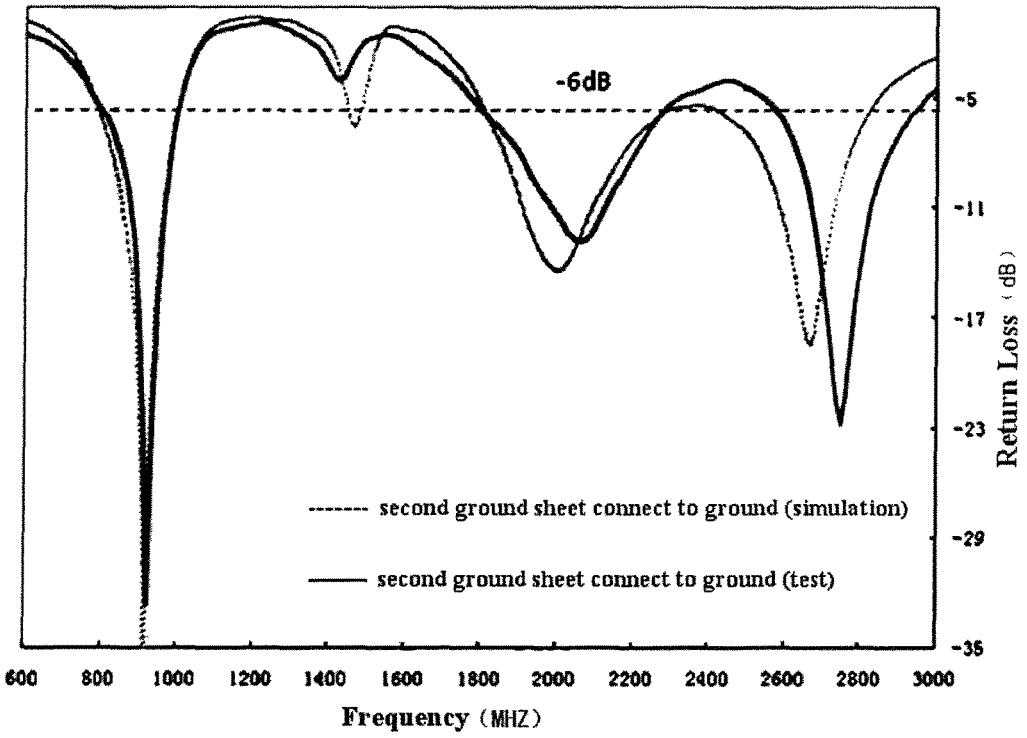
FIG. 10 is a simulation and measurement frequency-return loss graph of the antenna according to an embodiment of the present disclosure when the second ground sheet is connected to ground.
Figure 11:
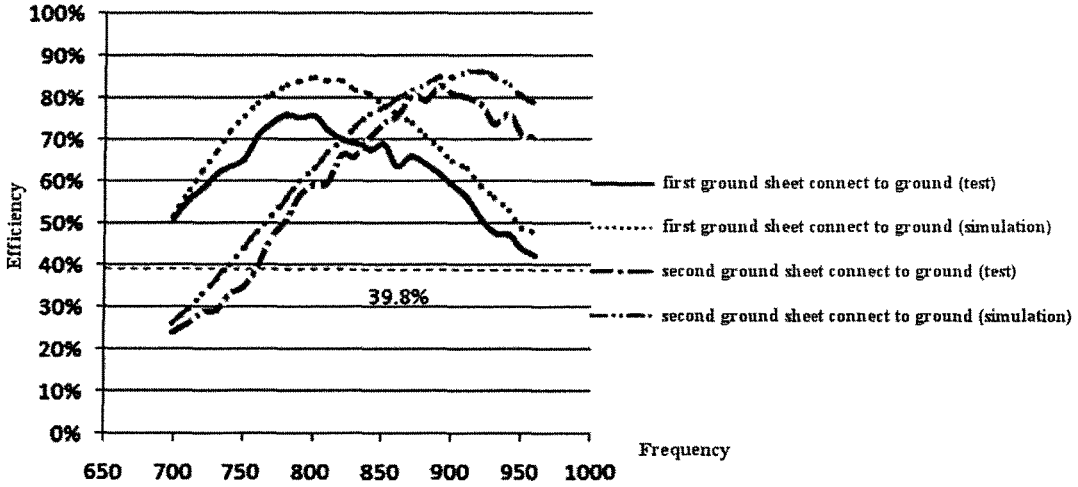
FIG. 11 and FIG. 12 are simulation and measurement frequency-efficiency graphs of the antenna according to an embodiment of the present disclosure.
Figure 12:
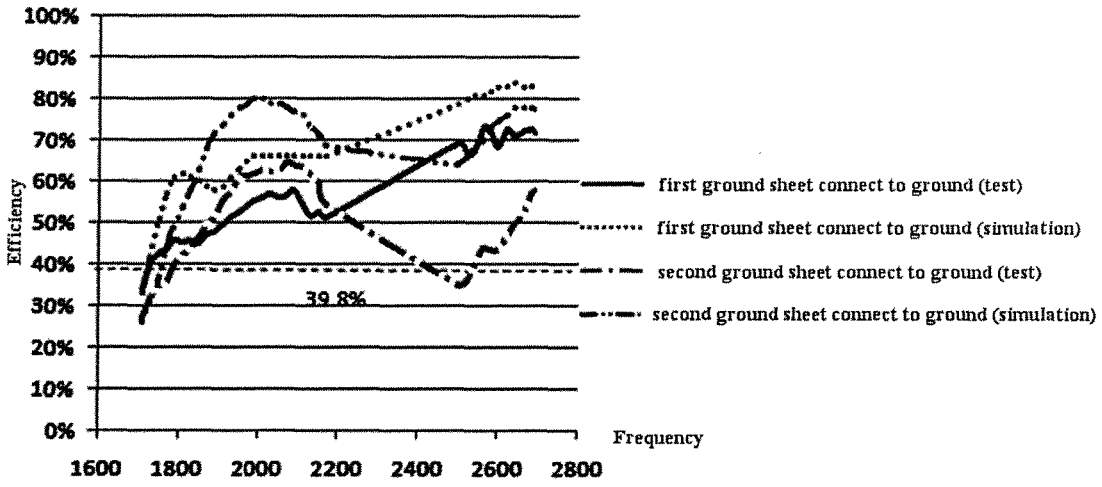

Specifically, as shown in FIG. 7 and FIG. 8, when the antenna frequency reconfiguration module controls the first ground sheet 40 to connect to ground, the first ground sheet 40 and the feed sheet 60 work, the first inverted F antenna is configured to a PIFA (Planar Inverted F Antenna) antenna, which is capable of generating low frequency of LTE and high frequency of DCS (Digital Cellular System), PCS (Personal Communications Service), UMTS (Universal Mobile Telecommunication System) and LTE. When the antenna frequency reconfiguration module controls the second ground sheet 50 to connect to ground, the second ground sheet 50 and the feed sheet 60 work, the second inverted F antenna is configured to a PIFA antenna, which is capable of generating a 2G (Second Generation Mobile Communication Technology Specification) frequency band of GSM (Global System for Mobile Communication) and CDMA (Code Division Multiple Access). Thereby, the antenna of the present disclosure is capable of switching two working modes through control of switching on or off of the two ground sheets, covering the low frequency of LTE, and high frequency of GSM, CDMA, DCS, PCS, UMTS and LTE, so as to cover the full frequency bands of global mobile phone calls.

Through simulating surface current of the antenna radiating sheet, what can be obtained is that: under a mode of the first ground sheet connecting to ground, that is a mode of the feed sheet 60 and the first ground sheet 40 working, a resonance is generated at a frequency of 765 MHz where an antenna length is ¼ wavelength of an electromagnetic wave signal, and there is a strong electric field at the end of the antenna radiating sheet limbs. Under a mode of the second ground sheet connecting to ground, that is a mode of the feed sheet 60 and the second ground sheet 50 working, a resonance is generated at an frequency of 947 MHz where an antenna length is ¼ wavelength of an electromagnetic wave signal, and there is a strong electric field at the end of the antenna radiating sheet limbs. Thereby, the switch of low frequency can be achieved through switching the two ground sheets connect to ground.

According to the antenna of the present disclosure, it is capable of covering the frequency bands of global 4G (Fourth Generation Mobile Communication Technology Specification) antenna of mobile phones, including LTE, GSM, CDMA, UMTS frequency bands; under a condition of the return loss below −6 dB, the ranges of frequency coverage are: low frequency from 699 MHz to 1000 MHz, high frequency from 1710 MHz to 2690 MHz, with 17 frequency bands in total.

Moreover, the first inverted F antenna and the second inverted F antenna share the antenna radiating sheet 10, so that reducing the antenna volume greatly, and frequency reconfiguration is achieved by the antenna frequency reconfiguration module through control of switching the first ground sheet 40 and the second ground sheet 50, compared with control of switching the feed point and the antenna radiating sheet in related arts, the present disclosure is simpler, easier to be achieved and has more reliable performance.

In addition, the antenna frequency reconfiguration module is disposed on the circuit board, thereby it is capable of simplifying the structure and preparing process of the antenna radiating sheet 10 greatly, and convenient for the antenna radiating sheet 10 to be formed integrally.

Therefore, the antenna of the present disclosure is capable of covering the full frequency bands of mobile phone calls, having the advantages of wide frequency bands, high radiation efficiency, small volume, simple structure and preparing process, and reliable performance.

In the following, the antenna structure of the present disclosure will be described in detail with reference to drawings.

In some embodiments of the present disclosure, as shown in FIG. 1 to FIG. 6, the antenna includes a circuit board (not shown in drawings), an antenna radiating sheet 10 and an antenna frequency reconfiguration module.

In which, the antenna radiating sheet 10 includes a horizontal part 11 and a vertical part 12 formed integrally. The horizontal part 11 is extended in a left and right direction (a direction of arrow C shown in FIG. 1 to FIG. 4) in a horizontal plane, the feed sheet 60 and the first ground sheet 40 is disposed on the back edge of the horizontal part 11 (the front and back direction is a direction of arrow B shown in FIG. 1 and FIG. 2). The vertical part 12 is extended in a left and right direction in a vertical plane, the upper edge of the vertical part 12 is connected with the front edge of the horizontal part 11 (the up and down direction is a direction of arrow A shown in FIG. 1, FIG. 3 and FIG. 4). The second ground sheet 50 is disposed on the lower edge of the vertical part 12. In other words, the cross section of the antenna radiating sheet 10 is L-shaped. It is not only convenient for the first slot 20 and the second slot 30 to form the first inverted F antenna and the second inverted F antenna on the antenna radiating sheet 10, but also convenient for the first ground sheet 40, the second ground sheet 50 and the feed sheet 60 to be disposed.

In some embodiments of the present disclosure, as shown in FIG. 1 to FIG. 5, the first slot 20 includes a first horizontal front and back limb 21, a first vertical up and down limb 22 and a first vertical left and right limb 23.

The first horizontal front and back limb 21 penetrates the horizontal part 11 in a front and back direction. The first vertical up and down limb 22 is disposed on the vertical part 12 and extended in an up and down direction, an upper end of the first up and down vertical limb 22 is connected with a front end of the first horizontal front and back limb 21. The first vertical left and right limb 23 is disposed on the vertical part 12 and extended in a left and right direction, a right end of the first vertical left and right limb 23 is connected with a lower end of the first vertical up and down limb 22.

Figure 2:
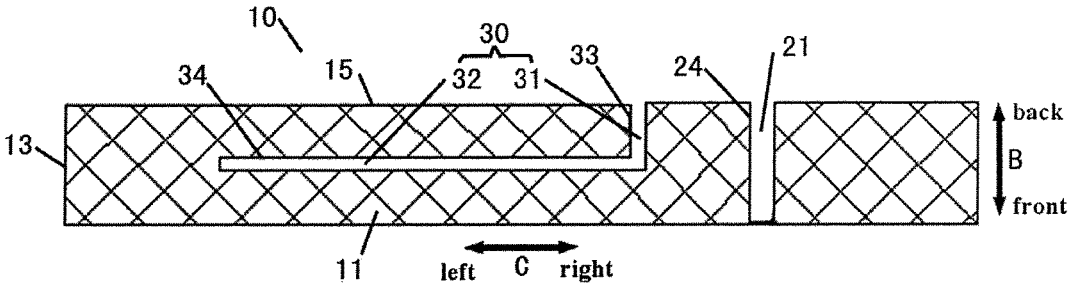
FIG. 2 is a top view of the antenna radiating sheet according to an embodiment of the present disclosure.
Figure 3:
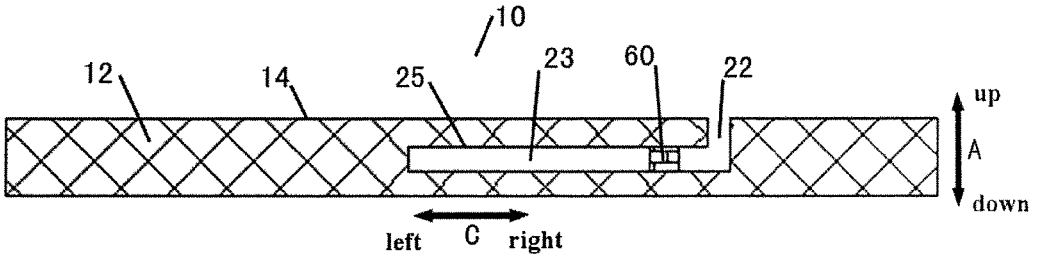
FIG. 3 is a front view of the antenna radiating sheet according to an embodiment of the present disclosure.
Figure 5:
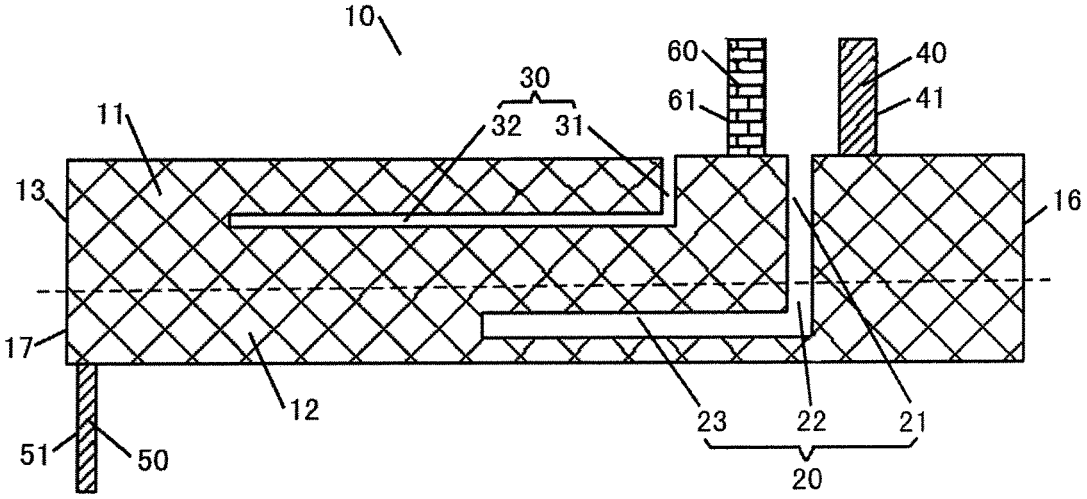
FIG. 5 is an unfolded plan of the antenna radiating sheet according to an embodiment of the present disclosure.

As shown in FIG. 1, FIG. 2 and FIG. 5, the second slot 30 includes a second horizontal front and back limb 31 and a second horizontal left and right limb 32.

The second horizontal front and back limb 31 is disposed on the horizontal part 11 and extended in a front and back direction; the second horizontal front and back limb 31 is located on the left side of the first horizontal front and back limb 21, the back edge of the horizontal part 11 is penetrated by a back end of the second horizontal front and back limb 31. The second horizontal left and right limb 32 is disposed on the horizontal part 11 and extended in a left and right direction, a right end of the second horizontal left and right limb 32 is connected with a front end of the second horizontal front and back limb 31.

FIG. 5 is an unfolded plan of the antenna radiating sheet, in which the dotted line is a 90 degree bend of the antenna radiating sheet 10. After the antenna radiating sheet is unfolded, the first slot 20 and the second slot 30 presented are both L-shaped, and the limbs of the first slot 20 parallel with the limbs of the second slot 30 correspondingly. Thereby, the first slot 20 and the second slot 30 are capable of forming the first inverted F antenna and the second inverted F antenna with ends trend being opposite, so that capable of improving isolation degrees of the first inverted F antenna and the second inverted F antenna, and the structure of the antenna radiating sheet 10 is simple, easy to be prepared, and the volume is small.

What needs to be understood is that: the first inverted F antenna and the second inverted F antenna have an overlapping portion, that is, the portion of the antenna radiating sheet 10 constitutes a part of the first inverted F antenna, and also constitutes a part of the second inverted F antenna. As shown in FIG. 5, the first slot 20 and the second slot 30 form three limbs generally on the antenna radiating sheet 10, the middle limb is capable of constituting a part of the first inverted F antenna, and also constituting a part of the second inverted F antenna.

In some embodiments of the present disclosure, all of the feed sheet 60, the first ground sheet 40 and the second ground sheet 50 are metal sheets, in which, the feed sheet 60 is connected with a RF cable.

As shown in FIG. 1, and FIG. 3 to FIG. 5, the feed sheet 60 is located between the first horizontal front and back limb 21 and the second horizontal front and back limb 31, the first ground sheet 40 is located on the right side of the first horizontal front and back limb 21, the feed sheet 60 and the first ground sheet 40 are respectively extended downward from the back edge of the horizontal part 11, and the lower ends thereof are bended towards the vertical part 12. When the first ground sheet 40 connects to ground, the first inverted F antenna works, which is constituted by the right limb and the middle limb of the antenna radiating sheet 10.

Figure 4:
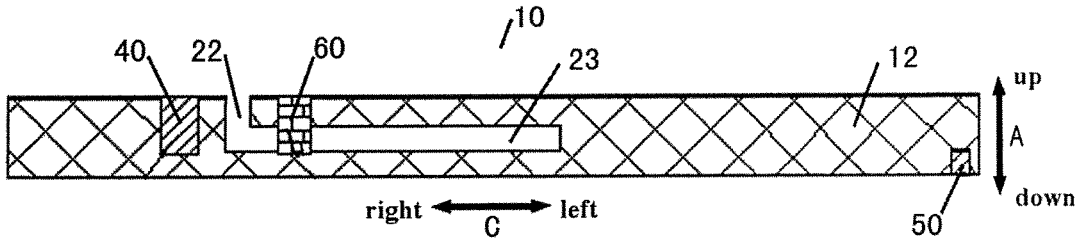
FIG. 4 is a back view of the antenna radiating sheet according to an embodiment of the present disclosure.

As shown in FIG. 1, FIG. 4 and FIG. 5, the second ground sheet 50 is disposed near to the left edge of the vertical part 12, extended backward from a lower edge of the vertical part 12, and furtherly bended upward and backward sequentially. When the second ground sheet 50 connects to ground, the second inverted F antenna works, which is constituted by the left, right and middle limbs of the antenna radiating sheet 10.

Through reasonable arrangement of the first ground sheet 40, the second ground sheet 50 and the feed sheet 60 on the horizontal part 11 and the vertical part 12, it is not only convenient for the connection of the antenna radiating sheet 10 and the antenna frequency reconfiguration module, but also convenient for the first inverted F antenna and the second inverted F antenna to work alone.

In the following, a specific antenna size of the present disclosure will be described in detail with reference to the drawings.

In some embodiments, the length of the horizontal part 11 and the vertical part 12 are both 20 mm to 100 mm and the thickness thereof are both 0.02 mm to 0.2 mm, a width of the horizontal part 11 is 1 mm to 20 mm, a width of the vertical part 12 is less than or equal to 10 mm. In some embodiments, the length of the horizontal part 11 and the vertical part 12 are both 62 mm, and the thickness thereof are both 0.05 mm, the width of the horizontal part 11 is 8.1 mm, the width of the vertical part 12 is 5.3 mm. In other words, the antenna radiating sheet 10 is a rectangular shape after being unfolded with a length of 62 mm, a width of 13.4 mm, a thickness of 0.05 mm. Thereby, it is capable of ensuring the antenna radiating sheet 10 having a small volume, meanwhile the reliability of performance is not affected.

Optionally, a distance between the left edge 24 of the first horizontal front and back limb 21 and the left edge 13 of the horizontal part 11 is 41.4 mm to 51.4 mm, a distance between the upper edge 25 of the first vertical left and right limb 23 and the upper edge 14 of the vertical part 12 is 1.5 mm to 2.5 mm, a length of the first vertical left and right limb 23 is 21 mm to 22 mm, the width of each of the first horizontal front and back limb 21, the first vertical up and down limb 22 and the first vertical left and right limb 23 are 1.1 mm to 2.1 mm. In some embodiments, the distance between the left edge 24 of the first horizontal front and back limb 21 and the left edge 13 of the horizontal part 11 is 46.4 mm, the distance between the upper edge 25 of the first vertical left and right limb 23 and the upper edge 14 of the vertical part 12 is 2 mm, the length of the first vertical left and right limb 23 is 21.4 mm. The width of each of the first horizontal front and back limb 21, the first vertical up and down limb 22 and the first vertical left and right limb 23 are 1.6 mm, that is, the width of each limb of the first slot 20 is the same, all of them is 1.6 mm. Thereby, it is capable of ensuring the frequency band coverage of the first inverted F antenna and the signal transmission effect.

A distance between the left edge 33 of the second horizontal front and back limb 31 and the left edge 13 of the horizontal part 11 is 38 mm to 39 mm, a distance between the back edge 34 of the second horizontal left and right limb 32 and the back edge 15 of the horizontal part 11 is 3.1 mm to 4.1 mm, a length of the second horizontal left and right limb 32 is 28.5 mm to 29.5 mm. Both the width of the second horizontal front and back limb 31 and the second horizontal left and right limb 32 are 0.5 mm to 1.5 mm. In some embodiments, the distance between the left edge 33 of the second horizontal front and back limb 31 and the left edge 13 of the horizontal part 11 is 38.4 mm, the distance between the back edge 34 of the second horizontal left and right limb 32 and the back edge 15 of the horizontal part 11 is 3.6 mm, the length of the second horizontal left and right limb 32 is 29 mm. Both the width of the second horizontal front and back limb 31 and the second horizontal left and right limb 32 are 1 mm, that is, the width of each limb of the second slot 30 is the same, all of them is 1 mm. Thereby, it is capable of ensuring the frequency band coverage of the second inverted F antenna and the signal transmission effect.

In some embodiments, a length of the feed sheet 60 is 5 mm to 15 mm and a width thereof is 1 mm to 7.5 mm, a distance between the left edge 61 of the feed sheet 60 and the left edge 13 of the horizontal part 11 is 42 mm to 45 mm. A length of the first ground sheet 40 is 5 mm to 15 mm and a width thereof is 1 mm to 10 mm, a distance between the right edge 41 of the first ground sheet 40 and the right edge 16 of the horizontal part 11 is less than or equal to 12 mm. In some embodiments, the length of the feed sheet 60 is 7.5 mm and the width thereof is 2.4 mm, the distance between the left edge 61 of the feed sheet 60 and the left edge 13 of the horizontal part 11 is 42.7 mm. The length of the first ground sheet 40 is 7.5 mm and the width thereof is 2.4 mm, the distance between the right edge 41 of the first ground sheet 40 and the right edge 16 of the horizontal part 11 is 9.7 mm. Thereby, it is not only capable of ensuring access effect of the feed sheet 60 and the first ground sheet 40, but also may be convenient for the frequency band coverage of the first inverted F antenna.

A length of the second ground sheet 50 is 5 mm to 15 mm and a width thereof is 1 mm to 10 mm, a distance between the left edge 51 of the second ground sheet 50 and the left edge 17 of the vertical part 12 is less than or equal to 1 mm. In some embodiments, the length of the second ground sheet 50 is 8.3 mm and the width thereof is 1.2 mm, the distance between the left edge 51 of the second ground sheet 50 and the left edge 17 of the vertical part 12 is 0.5 mm. Thereby, it is not only capable of ensuring access effect of the second ground sheet 50, but also may be convenient for the frequency band coverage of the second inverted F antenna.

In some embodiments of the present disclosure, the structure of the antenna frequency reconfiguration module is not limited, the antenna frequency reconfiguration module can be any reconfiguration module as long as can achieve switching one of the first ground sheet 40 and the second ground sheet 50 to connect to ground. For example, a diode reconfiguration module, a single-pole double throw reconfiguration module and a micro motor reconfiguration module.

In the following, the structure of the antenna frequency reconfiguration module of present disclosure will be described in detail with an example of the diode reconfiguration module.

Figure 6:
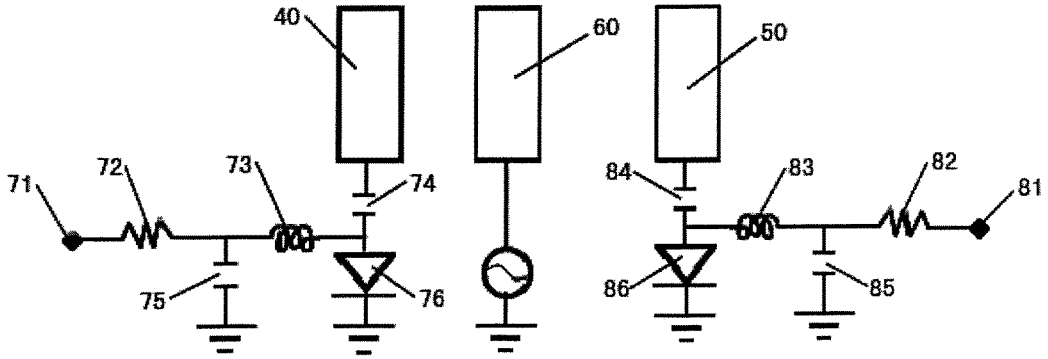
FIG. 6 is a part sketch of the antenna frequency reconfiguration module according to an embodiment of the present disclosure.

As shown in FIG. 6, the antenna frequency reconfiguration module is the diode reconfiguration module, including: a first controlling end 71, a first resistance 72, a first inductance 73, a first blocking capacitor 74, a first shunt capacitance 75, a first diode 76, a second controlling end 81, a second resistance 82, a second inductance 83, a second blocking capacitor 84, a second shunt capacitance 85 and a second diode 86.

The first controlling end 71 is connected with the first ground sheet 40 through a first resistance 72, a first inductance 73 and a first blocking capacitor 74 sequentially. The first shunt capacitance 75 is connected with a point between the first resistance 72 and the first inductance 73, and connected to ground. The first diode 76 is connected with a point between the first inductance 73 and the first blocking capacitor 74, and connected to ground. The second controlling end 81 is connected with the second ground sheet 50 through a second resistance 82, a second inductance 83 and a second blocking capacitor 84 sequentially. The second shunt capacitance 85 is connected with a point between the second resistance 82 and the second inductance 83, and connected to ground. The second diode 86 is connected with a point between the second inductance 83 and the second blocking capacitor 84, and connected to ground.

In the circuit of the antenna frequency reconfiguration module, a bias voltage of 3V is provided by a button battery, the first resistance 72 and the second resistance 82 are used to control a bias current, the first blocking capacitor 74 and the second blocking capacitor 84 are used to block DC, the first inductance 73 and the second inductance 83 are used to isolate RF signal, the first shunt capacitance 75 and the second shunt capacitance 85 are used for shunt. Thereby, it is capable of realizing to switch one of the first ground sheet 40 and the second ground sheet 50 to connect to ground.

Specifically, both the first resistance 72 and the second resistance 82 are 300Ω. All of the first blocking capacitor 74, the second blocking capacitor 84, the first shunt capacitance 75 and the second shunt capacitance 85 are 100 pF. Both the first inductance 73 and the second inductance 83 are 100 nH. The maximum resistance of both the first diode 76 and the second diode 86 are 0.5Ω under the action of 10 mA current. Thereby, it is capable of ensuring accuracy and reliability of the antenna frequency reconfiguration module controlling the first ground sheet 40 and the second ground sheet 50.

The antenna of the present disclosure embodiments is capable of covering the low frequency of LTE, the high frequency of the GSM, CDMA, DCS, PCS, UMTS and LTE, and having high emissivity and efficiency. As shown in FIG. 9 to FIG. 12, it is can be seen through simulation and laboratory test data, a total radiation efficiency of the antenna according to present disclosure embodiments is higher than the national standard, the higher the antenna radiation efficiency, the better the calling effect. The efficiency range of the low frequency of the LTE and 2G are 55.2%-80.6%, which is higher than the national standard of 39.8%; the efficiency range of 3G and the high frequency of the LTE are 43.8%-72.3%, which is higher than the national standard of 39.8%.

In the following, the mobile terminal of the present disclosure will be described. The mobile terminal includes the antenna of above embodiments of the present disclosure.

The mobile terminal, through utilizing the antenna according to the embodiment of the present disclosure, has the advantage of wide application scope, good calling effect, small volume, simple structure and preparing process, and reliable performance.

Specifically, the mobile terminal can be a mobile phone or a tablet computer.

The other structure and operation of the mobile terminal of the present disclosure is known to ordinary skilled person in this field, there is no need to described furtherly here.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. An antenna, wherein, comprising:

a circuit board;

an antenna radiating sheet, wherein the antenna radiating sheet comprises a first slot, a second slot, a first ground sheet, a second ground sheet, a feed sheet, a horizontal part, and a vertical part; the antenna radiating sheet is formed a first inverted F antenna connected with the first ground sheet and a second inverted F antenna connected with the second ground sheet by the first slot and the second slot; the feed sheet is respectively connected with the first inverted F antenna and the second inverted F antenna; the horizontal part is extended in a left and right direction in a horizontal plane, and the feed sheet and the first ground sheet are disposed on a back edge of the horizontal part; the vertical part is extended in a left and right direction in a vertical plane, an upper edge of the vertical part is connected with a front edge of the horizontal part, and the second ground sheet is disposed on a lower edge of the vertical part; and an antenna frequency reconfiguration module, wherein the antenna frequency reconfiguration module is disposed on the circuit board; the antenna frequency reconfiguration module is connected with the first ground sheet and the second ground sheet respectively, and connected to ground; the antenna frequency reconfiguration module is configured to switch one of the first ground sheet and the second ground sheet to connect to ground, wherein the first slot comprises:

a first horizontal front and back limb, wherein the first horizontal front and back limb penetrates the horizontal part in a front and back direction;

a first vertical up and down limb, wherein the first vertical up and down limb is disposed on the vertical part and extended in an up and down direction, and an upper end of the first up and down vertical limb is connected with a front end of the first horizontal front and back limb; and a first vertical left and right limb, wherein the first vertical left and right limb is disposed on the vertical part and extended in a left and right direction, and a right end of the first vertical left and right limb is connected with a lower end of the first vertical up and down limb.

2. The antenna according to claim 1, wherein, the second slot comprises:

a second horizontal front and back limb, wherein the second horizontal front and back limb is disposed on the horizontal part and extending in a front and back direction; the second horizontal front and back limb is located on the left side of the first horizontal front and back limb, the back edge of the horizontal part is penetrated by a back end of the second horizontal front and back limb;

a second horizontal left and right limb, wherein the second horizontal left and right limb is disposed on the horizontal part and extended in a left and right direction, a right end of the second horizontal left and right limb is connected with a front end of the second horizontal front and back limb.

3. The antenna according to claim 2, wherein, the feed sheet is located between the first horizontal front and back limb and the second horizontal front and back limb, the first ground sheet is located on the right side of the first horizontal front and back limb; the feed sheet and the first ground sheet are respectively extended downward from the back edge of the horizontal part, and their lower ends respectively bend towards the vertical part.

4. The antenna according to claim 3, wherein, the second ground sheet is disposed near to a left edge of the vertical part, and extended backward from a lower edge of the vertical part, bended upward and backward sequentially.

5. The antenna according to claim 4, wherein, a length of each of the horizontal part and the vertical part is 20 mm to 100 mm and a thickness of each thereof is 0.02 mm to 0.2 mm, a width of the horizontal part is 1 mm to 20 mm, a width of the vertical part is less than or equal to 10 mm.

6. The antenna according to claim 5, wherein, a distance between a left edge of the first horizontal front and back limb and a left edge of the horizontal part is 41.4 mm to 51.4 mm, a distance between an upper edge of the first vertical left and right limb and an upper edge of the vertical part is 1.5 mm to 2.5 mm, a length of the first vertical left and right limb is 21 mm to 22 mm, a width of each of the first horizontal front and back limb, the first vertical up and down limb and the first vertical left and right limb is 1.1 mm to 2.1 mm.

7. The antenna according to claim 5, wherein, a distance between a left edge of the second horizontal front and back limb and a left edge of the horizontal part is 38 mm to 39 mm, a distance between a back edge of the second horizontal left and right limb and the back edge of the horizontal part is 3.1 mm to 4.1 mm, a length of the second horizontal left and right limb is 28.5 mm to 29.5 mm, a width of each of the second horizontal front and back limb and the second horizontal left and right limb are 0.5 mm to 1.5 mm.

8. The antenna according to claim 5, wherein, a length of the feed sheet is 5 mm to 15 mm and a width thereof is 1 mm to 7.5 mm, a distance between a left edge of the feed sheet and a left edge of the horizontal part is 42 mm to 45 mm, a length of the first ground sheet is 5 mm to 15 mm and a width thereof is 1 mm to 10 mm, a distance between a right edge of the first ground sheet and a right edge of the horizontal part is less than or equal to 12 mm.

9. The antenna according to claim 5, wherein, a length of the second ground sheet is 5 mm to 15 mm and a width thereof is 1 mm to 10 mm, a distance between a left edge of the second ground sheet and a left edge of the vertical part is less than or equal to 1 mm.

10. The antenna according to claim 1, wherein, the antenna frequency reconfiguration module is selected from a group consisting of a diode reconfiguration module, a single-pole double throw reconfiguration module and a micro motor reconfiguration module.

11. The antenna according to claim 10, wherein, the antenna frequency reconfiguration module is the diode reconfiguration module, comprising:

a first controlling end, wherein the first controlling end is connected with the first ground sheet through a first resistance, a first inductance, and a first blocking capacitor sequentially;

a first shunt capacitance, wherein the first shunt capacitance is connected with a point between the first resistance and the first inductance, and connected to ground;

a first diode, wherein the first diode is connected with a point between the first inductance and the first blocking capacitor, and connected to the ground;

a second controlling end, wherein the second controlling end is connected with the second ground sheet through a second resistance, a second inductance and a second blocking capacitor sequentially;

a second shunt capacitance, wherein the second shunt capacitance is connected with a point between the second resistance and the second inductance, and connected to the ground;

a second diode, wherein the second diode is connected with a point between the second inductance and the second blocking capacitor, and connected to the ground.

12. A mobile terminal, wherein, comprising the antenna according to claim 1.

13. A antenna radiating sheet, comprising a first slot, a second slot, a first ground sheet, a second ground sheet, a feed sheet, a horizontal part, and a vertical part; wherein the antenna radiating sheet is formed a first inverted F antenna connected with the first ground sheet and a second inverted F antenna connected with the second ground sheet by the first slot and the second slot; the feed sheet is respectively connected with the first inverted F antenna and the second inverted F antenna; the horizontal part is extended in a left and right direction in a horizontal plane, and the feed sheet and the first ground sheet are disposed on a back edge of the horizontal part; the vertical part is extended in a left and right direction in a vertical plane, an upper edge of the vertical part is connected with a front edge of the horizontal part, and the second ground sheet is disposed on a lower edge of the vertical part; and wherein the first slot comprises:

a first horizontal front and back limb, wherein the first horizontal front and back limb penetrates the horizontal part in a front and back direction;

a first vertical up and down limb, wherein the first vertical up and down limb is disposed on the vertical part and extended in an up and down direction, and an upper end of the first up and down vertical limb is connected with a front end of the first horizontal front and back limb; and a first vertical left and right limb, wherein the first vertical left and right limb is disposed on the vertical part and extended in a left and right direction, and a right end of the first vertical left and right limb is connected with a lower end of the first vertical up and down limb.

* * * * *